US005402091A

United States Patent [19]

Ikeuchi

[11] Patent Number: 5,402,091

[45] Date of Patent: Mar. 28, 1995

[54] FRAME BODY FOR USE IN WINDING A COIL FOR DEFLECTION YOKE

[75] Inventor: Hiroshi Ikeuchi, Nagaokakyo, Japan

[73] Assignee: Murata Mfg. Co., Ltd., Kyoto, Japan

[21] Appl. No.: 125,932

[22] Filed: Sep. 23, 1993

[30] Foreign Application Priority Data

Sep. 28, 1992 [JP] Japan ..... 4-073338 U

[51] Int. Cl.[6] ..... H01F 7/00; H01H 1/00; G09G 1/04; H01J 29/70

[52] U.S. Cl. ..... 335/210; 335/213; 315/368.25; 313/421; 242/7.07; 29/605

[58] Field of Search ..... 335/210, 213; 358/248; 315/368.25; 140/71 B, 71.5, 92.1; 313/343; 242/7.07, 7.09, 7.11; 29/605, 606

[56] References Cited

U.S. PATENT DOCUMENTS 4,152,685 5/1979 Renders ..... 335/213
4,937,931 7/1990 Jacobs ..... 29/605
5,258,734 11/1993 Tamai ..... 335/213

FOREIGN PATENT DOCUMENTS 405209 1/1991 European Pat. Off. .
2129122 12/1971 Germany ..... 335/213
2516577 10/1976 Germany .
2940931 4/1981 Germany ..... 335/213
19032 1/1986 Japan ..... 335/213
208532 9/1987 Japan ..... 313/440
274535 11/1987 Japan ..... 313/440

*Primary Examiner*—Leo P. Picard
*Assistant Examiner*—Stephen T. Ryan
*Attorney, Agent, or Firm*—Rogers, Howell & Haferkamp

[57] ABSTRACT

A coil-winding frame body for deflection yoke coil, includes: a straight portion formed as a neck side; a trumpet-shaped curved surface portion spreading outward from the end of the straight portion toward a head side; and a plurality of flanges formed on the inner face of the body for defining a plurality of coil-winding grooves and walls, and each of the grooves is elongated from the neck side to the head side and into which a wire ribbon will be wound in layers. In the thus constructed coil-winding frame body, at least one of the plurality of coil-winding grooves includes a main groove in the straight portion which in turn is divided in the curved surface portion into a plurality of branch grooves, and the plurality of branch grooves are arranged such that an extended line from an inner side wall of each the branch groove converges at a common end point on the straight portion of an inner side wall of the main groove, whereas an extended line from an outer side wall of each of the branch grooves converges at a common end point on the straight portion of an outer side wall of the main groove.

12 Claims, 5 Drawing Sheets

FRAME BODY FOR USE IN WINDING A COIL FOR DEFLECTION YOKE

BACKGROUND OF THE INVENTION

1. Field of the Invention

The present invention relates to a frame body for use in winding a coil for a deflection yoke mounted on television receivers or display units, etc.

2. Description of the Prior Art

In recent years, development of television receivers into high-resolution and highly fine display units, increasingly tend to demand strict specifications relating to color mismatching, i.e., convergence of the cathode-ray tube screen of these apparatus. Under such tendency, it is earnestly desired that a deflection magnetic field be controlled more precisely.

A deflection yoke mounted on a cathode ray tube of a television receiver or display unit is generally composed of a bobbin 2 as a funnel-shaped winding frame body, with horizontal deflection coils attached to the bobbin 2 on its inner side at both top and bottom, and with vertical deflection coils attached to the outside of the bobbin 2.

FIG. 1 shows an example of a bobbin for a saddle type deflection coil for use in a typical deflection yoke. The bobbin 2 is provided with a plurality of coil-winding grooves 5, on which, for example, a coiling wire 11 is wound in layers as shown in FIG. 2, to thereby form a deflection coil. The coiling wire 11 is a conductive wire (such as litz wires for example) with an insulating layer 4. In winding the coiling wire 11 on the aforementioned coil-winding grooves 5, the coiling wire 11 is wound in layers by an automatic winding machine, one by one, or by every some number of wires, thereby producing a deflection coil.

Such prior art deflection coil, however, suffers from drawbacks. Variation in directions of the stretching force acted on coiling wire 11 as it was wound may have caused displacement and biasing as shown in FIG. 2. In other cases, the order of winding of coiling wire 11 can be altered and hence such winding as previously designated by a design instruction cannot be effected. Further, the biased states of coiling wire 11 of deflection coils that are mass-produced differ from one another. Therefore, it would be impossible to regulate a deflection field with high precision. Additionally, mass-production makes variations in winding larger, resulting in lowering of the yield, and hence the prior art winding method is disadvantageous in view of cost. Even in the just-mentioned prior art method, the displacement and biased state of the coiling wire 11 wound can be reduce for satisfy the original design as the width of the coil-winding grooves is narrowed, but this results in coil performance deteriorization because, of the ratio L/R between inductance L and resistance R being reduced.

In order to eliminate such problems, the present applicant has previously proposed a deflection coil which is formed using a wire ribbon in place of winding a single wire one by one as used to be practiced.

Examples of wire ribbon 15 include one that is composed as shown in FIG. 3A by arranging in parallel a plurality of conductive wires 8 of copper, aluminum or the like with an insulating layer 4 coated thereon, and adhering them using an adhesive 6. Another wire ribbon is composed as shown in FIG. 3B by arranging in parallel a plurality of conductive wires 8 with an insulating layer 4 coated thereon, and adhering together the wires on one side of an insulator sheet 7 made of resin, etc., with an adhesive 6. A further wire ribbon is composed as shown in FIG. 3C by arranging and adhering together in parallel a plurality of conductive wires 8 formed with an insulating layer 4 and an adhesive layer 9.

The conductive wires 8 forming the aforementioned wire ribbon 15 are arranged and fixed in parallel with one another in an orderly manner in a row, and therefore, neither will each conductive wire 8 be displaced in wire ribbon 15, nor will the order of the wires be altered. Therefore, when this wire ribbon 15 is used, namely, the wire ribbon 15 is wound in layers, it is possible to produce a deflection coil free from the aforementioned problems such as significant displacement of the conductive wires 8, and the like.

The production of such a deflection coil as described above is achieved by inserting the wire ribbon into a coil-winding groove 5 having a flange 3 so as to wind it in layers along a bottom face 10 of the groove 5.

Meanwhile, the bobbin 2 has a coil-winding frame body on which the wire ribbon 15 is wound, comprising a straight portion S on its neck side N and a curved surface portion R spreading outward from the end of the straight portion S toward its head side H. There are provided a plurality of coil-winding grooves 5 on the inner face of the curved surface portion elongated from the neck side to the head side H. Of these grooves, one particular coiling groove in the straight portion S (to be referred to as a main groove **5*e*) becomes divided in the curved surface portion R into a plurality of branch grooves (in this example, three branch grooves 5*f*, 5*g* and 5*h***).

In the prior art coil-winding frame body having a structure described above, the branch groove thus divided used to be formed so as to be wider than a wire ribbon used by leaving a margin equal to the dimensional tolerance of the ribbon, and points at which branch grooves branch off the main groove would vary. For this reason, when the wire ribbon 15 were wound in layers onto the coil-winding grooves constructed as above, the wire ribbon 15 would be displaced or biased in the width direction. Further, since the starting points at which the branch grooves **5*f*, 5*g* and 5*h* branch off the main groove 5*e* were different or unregulated in position, the wire ribbon 15** would come in contact with edges of the groove side walls, etc., at branching points and therefore could not enter the groove smoothly. Accordingly, the wire ribbon could be twisted at the contact point while being wound, thus giving rise to a problem that the dimensional accuracy would be deteriorated. Hence, it has been difficult for the thus constructed deflection coil to control a deflection magnetic field with precision.

SUMMARY OF THE INVENTION

The present invention has been achieved in view of what has been discussed above, and it is, therefore, an object of the present invention to provide a frame body for use in winding a coil for a deflection yoke wherein, when a wire ribbon is wound into coil-winding grooves, the wire ribbon can be wound exactly without being twisted.

In accordance with a main aspect of the present invention, the above object of the present invention can be achieved by providing a coil-winding frame body for deflection yoke coil, comprising:

a straight portion formed as a neck side; a trumpet-shaped curved surface portion spreading outward from the end of the straight portion toward a head side; and, a plurality of flanges formed on the inner face of the body for defining a plurality of coil-winding grooves and walls, each of the grooves being elongated from the neck side to the head side and into which a wire ribbon will be wound in layers;

the frame body being characterized in that at least one of the plurality of coil-winding grooves comprises a main groove in the straight portion which in turn is divided in the curved surface portion into a plurality of branch grooves, and the plurality of branch grooves are arranged such that an extended line from an inner side wall of each branch groove converges at a common end point on the straight portion of to an inner side wall of the main groove, whereas an extended line from an outer side wall of each of the branch grooves converges at a common end point on the straight portion of an outer side wall of the main groove.

In accordance with the present invention, when the direction in which the wire ribbon is placed on the coil-winding frame body is changed from the main groove to a branch groove, the wire ribbon advances in the same direction with that in which the side wall of the branch groove extends, so that the wire ribbon is appropriately overlaid on the branch groove, positioned and inserted in place thereinto. Therefore, the wire ribbon can be wound in exact fit into the groove. Further, since, when shifted into a next branch groove, the trail of the wire ribbon branches off the main groove at the same point in which the trail of the previously wound wire ribbon branches off the main groove, the wire ribbon can be smoothly inserted into the grooves without being twisted.

In the present invention, the branch grooves are arranged such that an extended line from an inner side wall of each branch groove converges at a common end point on the straight portion of an inner side wall of the main groove and an extended line from an outer side wall of each of the branch grooves coverages at a common end point on the straight portion of an outer side wall of the main groove. Accordingly, the trail of the wire ribbon branches off at the same turning point all the time when winding of the wire ribbon is deflected from the main groove to a branch groove. Therefore, no deterioration occurs due to interference such as twisting of a winding trail of the wire ribbon with a different winding trail of the wire ribbon, since both trails start from the same turning point mentioned above. (More specifically, an interference such as a twist will be caused when the lower-layered, wound wire ribbon in one branch groove exerts an adverse influence upon the upper-layered, wound wire ribbon in another branch groove). Moreover, since the wire ribbon is appropriately overlaid on the branch groove, positioned and inserted in place thereinto, the wire ribbon can be inserted into the branch groove without contact with the edges, corners, etc., of the side walls of the branch groove, and can be wound in exact fit into the groove. As a result, it is possible to produce an excellent deflection yoke coil, whereby a deflection magnetic field can be controlled with precision.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF PREFERRED EMBODIMENT

Figure 1:
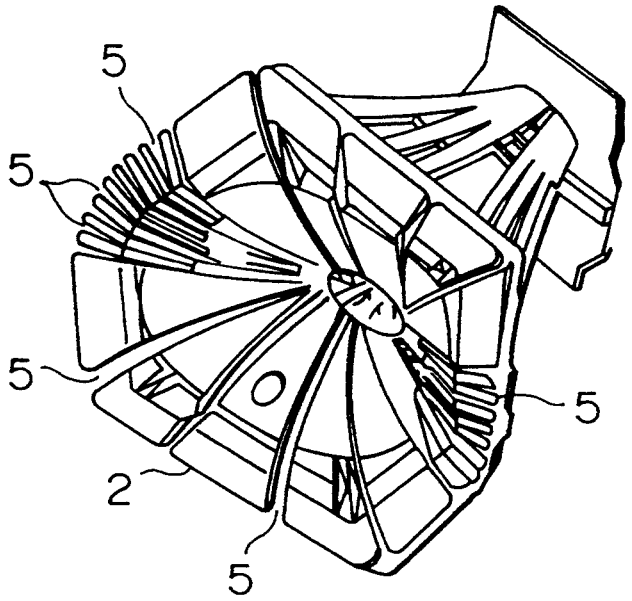
FIG. 1 PRIOR ART
FIG. 1 is a schematic perspective view showing an example of a winding frame body of a prior art deflection yoke coil.
Figure 2:
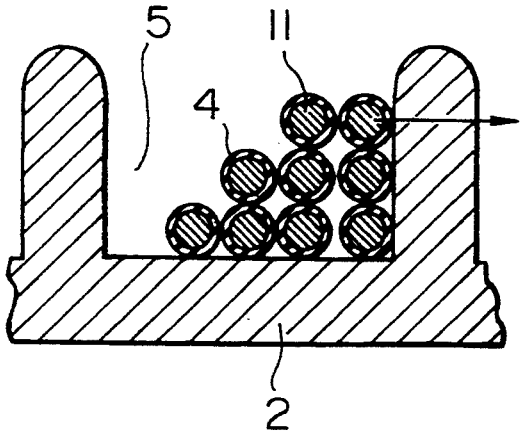
FIG. 2 PRIOR ART
FIG. 2 is a sectional view partially showing a state of coil-winding in a prior art deflection coil.
Figure 3A:
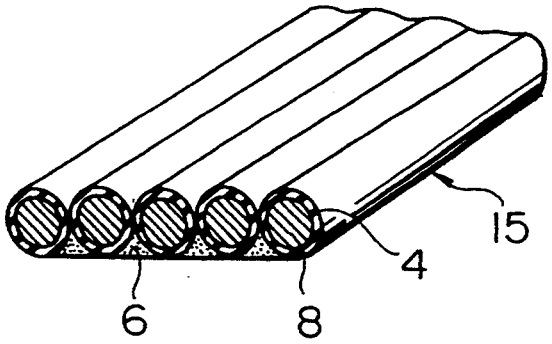
FIG. 3A PRIOR ART
FIG. 3A to 3C are schematic perspective and sectional views showing different types of prior art wire ribbons.
Figure 3B:
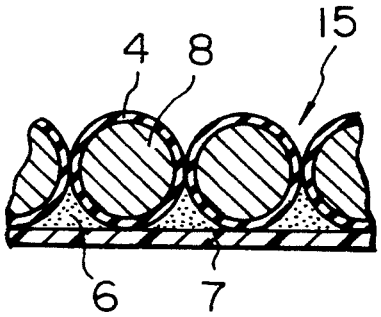
FIG. 3B PRIOR ART
Figure 3C:
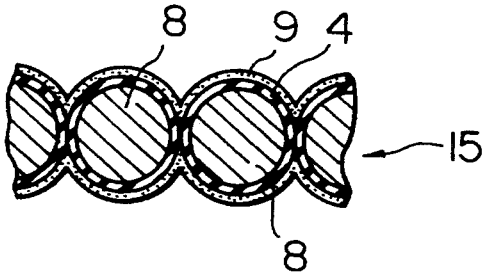
FIG. 3C PRIOR ART
Figure 4:
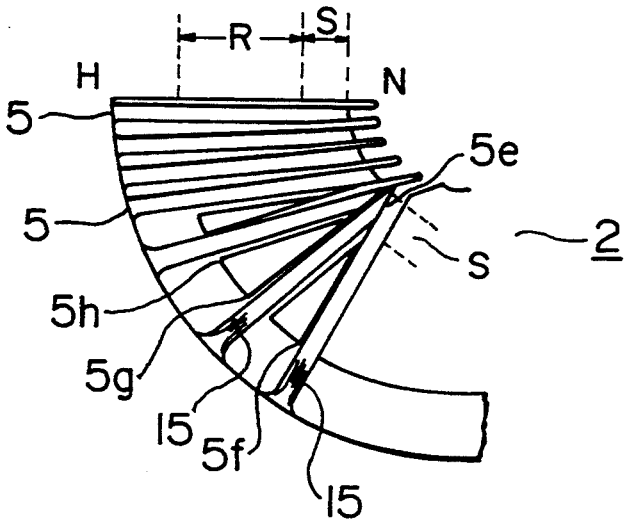
FIG. 4 PRIOR ART
FIG. 4 is a plan view showing another example of a winding frame body of a prior deflection yoke coil.
Figure 5:
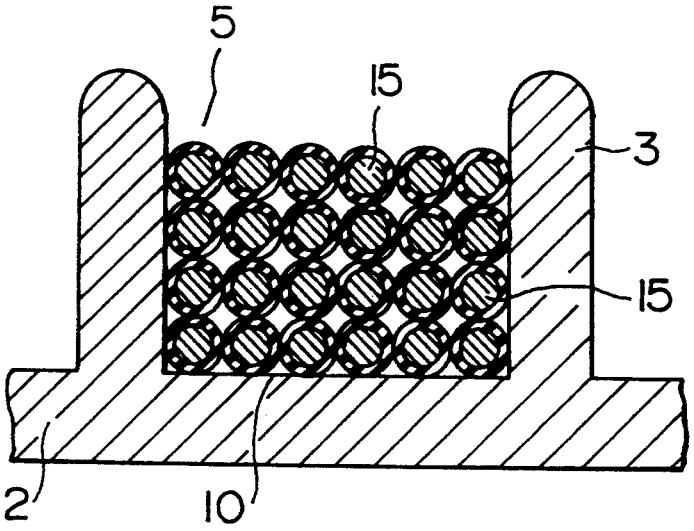
FIG. 5 PRIOR ART
FIG. 5 is a partial sectional view showing a layered state of a wire ribbon wound on a winding frame body shown in FIG. 4.
Figure 6:
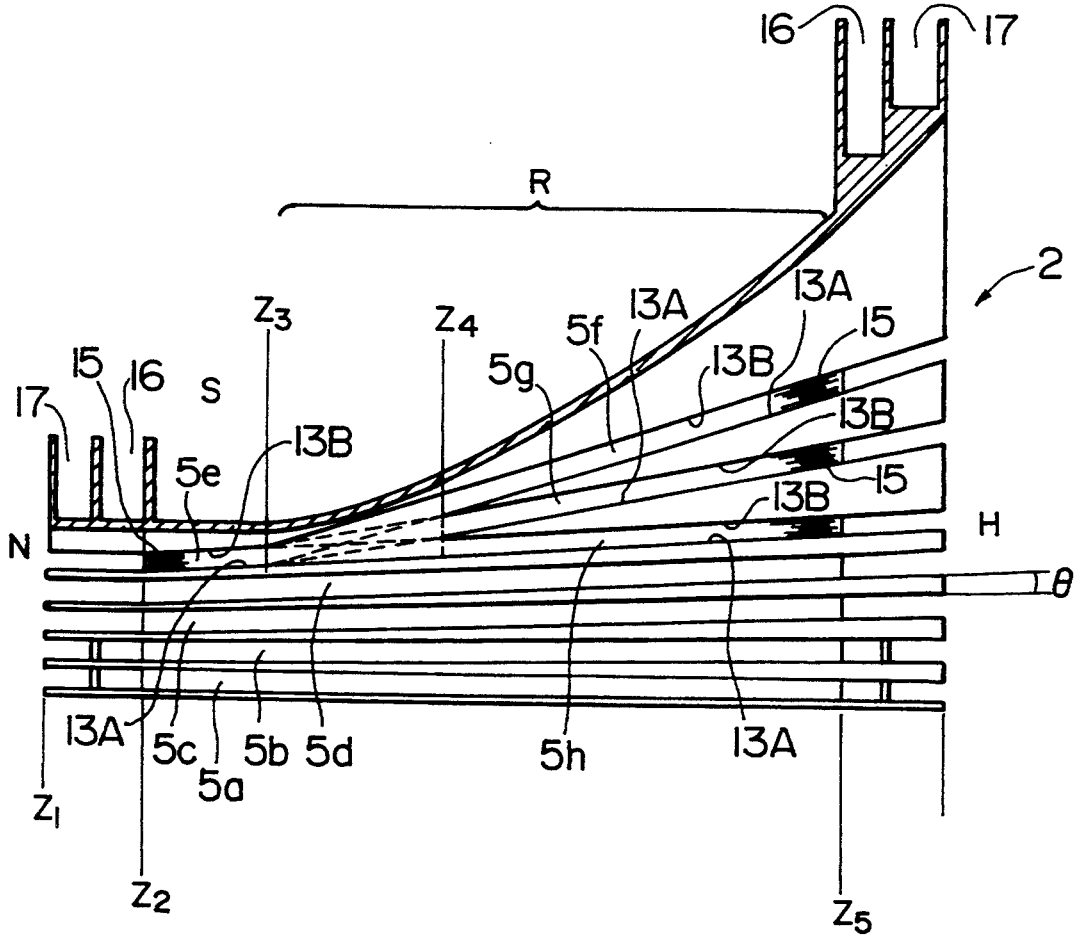
FIG. 6 is an elevational view partially sectioned, showing an upper half portion of an embodied winding frame body for a deflection yoke coil according to the present invention.
Figure 7A:
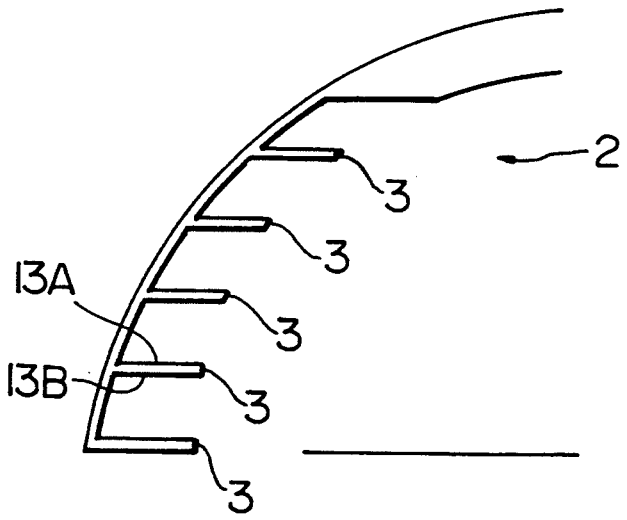
FIG. 7A and 7B are illustrative views showing different examples of flange shapes of coil-winding grooves applicable to a winding frame shown in FIG. 6.
Figure 7B:
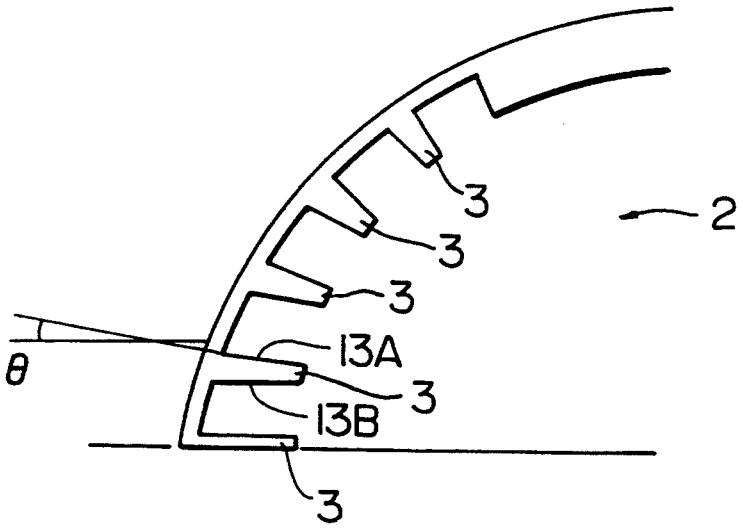

Some preferred embodiments of the present invention will be described hereinafter with reference to the accompanying drawings (FIGS. 6, 7A and 7B). In the description herein, the same portions having the same functions with those in the prior art described above will be designated at the corresponding reference numerals, and description of those portions will be omitted in order to avoid repetition.

FIG. 6 is an elevational section showing an upper half part of a deflection yoke coil-winding frame body (to be referred to as a bobbin) cut in half in accordance with the present embodiment. In this figure, there is provided a bobbin 2, which comprises a straight portion S on its neck side N and a curved surface portion spreading outward from the end of the straight portion S toward its head side H. Formed on the inner face of the bobbin are a plurality of coil-winding grooves which are elongated from the neck side N to the head side H and into which a wire ribbon will be wound in layers. Of these grooves, one particular coiling groove formed in the straight portion S, namely, a main groove **5*e*, becomes divided in the curved surface portion R into a plurality of branch grooves (in the embodiment shown, three branch grooves 5*f*, 5*g* and 5*h*). All the branch grooves 5*f*, 5*g* and 5*h* separated have an identical width and are of linear shape. Each of the branch grooves 5*f*, 5*g* and 5*h* are arranged such that an extended line from an inner side wall 13A of each branch groove coverages at an end point $Z_3$ on inner side wall 13A of the main groove 5*e*, whereas an extended line from an outer side wall 13B of each of the branch grooves 5*f*, 5*g* and 5*h* coverages at an end point $Z_3$ on outer side wall 13B of the main groove 5*e*. Accordingly, each of the branch grooves 5*f*, 5*g* and 5*h* branches off the main groove 5*e* at the identical point. As a result, the direction in which the wire ribbon advances as it is wound from the main groove 5*e* to each of the branches 5*f*, 5*g* and 5*h*** corresponds to the direction along which the side wall of each branch groove extends.

As shown in FIG. 7A, flanges 3 of the bobbin 2 are formed such that, for example, each of the inside groove side walls 13A for flanges makes a constant inclination with a corresponding outside groove side wall 13B for the same flange (in this case, all the walls are in parallel with each other). When the inside groove side walls 13A are inclined against the respective outside groove side walls 13B, the configuration is formed such that, as shown in FIG. 7B, the inclination angle made between an inside groove side wall 13A and a corresponding outside groove side wall 13B may be equal to $\theta$. In this case, the main straight groove and each of the branch straight grooves forms an angular portion at a boundary therebetween, the corner should be rounded if necessary.

A deflection yoke coil using a bobbin of the embodiment can be prepared as in the following manner.

First of all, as shown in FIG. 6, a wire ribbon 15 is placed into a main groove 5*e* in the straight portion S, and then is wound along the inner side of a first branch groove 5*f*. Next, the wire ribbon is placed into an inner groove 16 in a crossover portion on the head side H, thereafter, is wound into the inner side of an unillustrated branch groove opposite to the branch groove 5*f* (a branch groove to be disposed in a mirrored position of the branch groove 5*f* with respect to a central axis of the bobbin shown in FIG. 6). Then, the wire ribbon returns to the starting side along an inner groove 16 disposed in the neck side N. The same operation will be repeated a predetermined number of times. Thereafter, when transferred into a next branch groove 5*g* from the main groove 5*e*, the wire ribbon will start to be wound on the branch groove 5*g* from a position at which the first branch groove 5*f* branches off the main groove 5*e*. As in the similar manner, the wire ribbon will be wound along the next circuits along a branch groove 5*h*. All the branch grooves 5*f*, 5*g* and 5*h* have been layeredly occupied with the wire ribbon, then the wire ribbon will be wound up into successive coil winding grooves to complete a deflection coil. Here, when the wire ribbon is wound into the last two coil-winding grooves 5*a* and 5*b*, the wire ribbon should be passed through an outside crossover groove 17.

In accordance with the embodiment, since the bobbin 2 is constructed such that the branch grooves 5*f*, 5*g* and 5*h*, all formed in the curved portion, branch off at the same point from the main groove 5*e* formed in the straight portion S of the bobbin 2, and since the main groove and the branch grooves are all of linear groove structure having substantially as much a width as the wire ribbon 15, the wire ribbon 15 may advance in the same direction with that in which the side wall of the branch groove extends, to thereby be overlaid on the previously wound ribbon when the wire ribbon changes the direction in which it travels from the main groove 5*e* to each of the branch grooves 5*f*, 5*g* and 5*h*. Therefore, when the wire ribbon is brought into the groove, there occurs no frictional contact of the wire ribbon with the edge portion, etc., of the groove side walls, so that the wire ribbon 15 will be smoothly inserted into the grooves without being twisted and therefore will be wound exactly fitting into the grooves, thus making it possible to form an excellent deflection yoke coil, which in turn allows exact control of a deflection magnetic field.

In addition, since the side walls for both the main groove and the branch grooves are made straight, the mold die for the bobbin can be prepared easily.

It should be understood that the present invention is not limited to the above embodiment, and that various modifications may be made therein. For example, although the bobbin 2 is used as a coil-winding frame body for making a deflection yoke coil, a mold metal die, for example, can be used as the winding frame body. In such a case, the deflection coil formed must be separated from the metal die after the completion.

Further, although in the above embodiment, the main groove 5*e* was assumed to be branched into three branch grooves 5*f*, 5*g* and 5*h*, the main groove may be parted into two, or four or more of the branch grooves.

Moreover, although the coil-winding groove of the above embodiment is formed substantially as wide as the wire ribbon used, the groove may be formed much broader than the wire ribbon, thereby leaving a margin.

What is claimed is:

1. A coil-winding frame body for a deflection yoke coil, comprising:

a straight portion formed as a neck side; a trumpet-shaped curved surface portion spreading outward from the end of said straight portion toward a head side; and a plurality of flanges formed on an inner face of said body for defining a plurality of coil-winding grooves and walls, each of said grooves being elongated from said neck side to said head side and into which a wire ribbon will be wound in layers;

being characterized in that at least one of said plurality of coil-winding grooves comprises a main groove in said straight portion which in turn is divided in said curved surface portion into a plurality of branch grooves, and said plurality of branch grooves are arranged such that an extended line from an inner side wall of each said branch grooves converges at a common end point on said straight portion of an inner side wall of said main groove, whereas an extended line from an outer side wall of each of said branch grooves converges at a common end point on said straight portion of an outer side wall of said main groove.

2. A coil-winding frame body for a deflection yoke coil, according to claim 1, wherein both said main groove and said branch grooves are of substantially straight structure.

3. A coil-winding frame body for a deflection yoke coil, according to claim 1, wherein said branch grooves all have substantially the same width.

4. A coil-winding frame body for a deflection yoke coil, according to claim 2, wherein said branch grooves all have substantially the same width.

5. A coil-winding frame body for a deflection yoke coil, according to claim 1, wherein each of said flanges defines one of said inner side walls and one of said outer side walls of adjacent coil-winding grooves such that a constant inclination angle is formed between said inner side wall and said outer side wall defined by the same flange.

6. A coil-winding frame body for a deflection yoke coil, according to claim 2, wherein each of said flanges defines one of said inner side walls and one of said outer side walls of adjacent coil-winding grooves such that a constant inclination angle is formed between said inner side wall and said outer side wall defined by the same flange.

7. A coil-winding frame body for a deflection yoke coil, according to claim 3, wherein each of said flanges defines one of said inner side walls and one of said outer side walls of adjacent coil-winding grooves such that a constant inclination angle is formed between said inner side wall and said outer side wall defined by the same flange.

8. A coil-winding frame body for a deflection yoke coil, according to claim 4, wherein each of said flanges defines one of said inner side walls and one of said outer side walls of adjacent coil-winding grooves such that a constant inclination angle is formed between said inner side wall and said outer side wall defined by the same flange.

9. A trumpet-shaped coil-winding frame body for a deflection yoke coil, said frame body comprising a plurality of flanges defining a plurality of elongated coil-winding grooves, and at least one of said coil-winding grooves comprising a main groove and a plurality of branch grooves, said plurality of branch grooves dividing from said main groove at the same longitudinal point, wherein said at least one main groove and said plurality of branch grooves each comprise an inner side wall and an outer side wall, said plurality of branch grooves arranged such that lines extended from said branch groove inner side walls intersect at a point 1 on said main groove inner side wall and lines extended from said branch groove outer side walls intersect at a point 2 on said main groove outer side wall, said point 1 and said point 2 being at substantially the same longitudinal point of said main groove.

10. The coil-winding frame body of claim 9 wherein said plurality of branch grooves each have substantially the same width.

11. A trumpet-shaped coil-winding frame body for a deflection yoke coil, said frame body comprising a plurality of flanges defining a plurality of elongated coil-winding grooves, and at least one of said coil-winding grooves comprising a main groove and a plurality of branch grooves, said plurality of branch grooves dividing from said main groove at the same longitudinal point, wherein each of said plurality of flanges defines an inner side wall for one of said plurality of coil-winding grooves and an outer side wall for an adjacent coil-winding groove, so that a constant inclination angle is formed between said inner side wall and said outer side wall defined by the same flange.

12. The coil-winding frame body of claim 11 wherein the flange forms a branch groove.

* * * * *